US008041280B2

(12) United States Patent
Koike et al.

(10) Patent No.: US 8,041,280 B2
(45) Date of Patent: Oct. 18, 2011

(54) LUBRICANT APPLYING DEVICE, PROCESS CARTRIDGE, AND IMAGE FORMING APPARATUS

(75) Inventors: Toshio Koike, Tokyo (JP); Hiroyuki Nagashima, Kanagawa (JP); Nobuo Kuwabara, Kanagawa (JP); Fumihito Itoh, Kanagawa (JP); Masahiko Shakuto, Kanagawa (JP); Ken Amemiya, Tokyo (JP); Yuji Arai, Kanagawa (JP); Michiya Okamoto, Kanagawa (JP); Hiroshi Ono, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 400 days.

(21) Appl. No.: 12/408,360

(22) Filed: Mar. 20, 2009

(65) Prior Publication Data

US 2009/0241830 A1 Oct. 1, 2009

(30) Foreign Application Priority Data

Mar. 26, 2008 (JP) ..... 2008-080578
Sep. 8, 2008 (JP) ..... 2008-230173

(51) Int. Cl.
*G03G 21/00* (2006.01)

(52) U.S. Cl. ..... 399/346

(58) Field of Classification Search ..... 399/98, 399/99, 123, 343, 346, 350, 351, 353–355, 399/357

See application file for complete search history.

(56) References Cited

U.S. PATENT DOCUMENTS

| | | | | |
|---|---|---|---|---|
| 5,646,718 | A * | 7/1997 | Suwa et al. | 399/350 |
| 7,050,741 | B2 | 5/2006 | Koike et al. | |
| 7,224,930 | B2 * | 5/2007 | Oda et al. | 399/359 |
| 7,313,347 | B2 | 12/2007 | Shintani et al. | |
| 7,376,380 | B2 | 5/2008 | Koike et al. | |
| 7,386,257 | B2 | 6/2008 | Koike et al. | |
| 7,430,377 | B2 | 9/2008 | Koike et al. | |
| 7,493,075 | B2 | 2/2009 | Shintani et al. | |
| 2005/0191574 | A1 | 9/2005 | Koike et al. | |
| 2005/0232665 | A1 | 10/2005 | Toshio et al. | |
| 2007/0036595 | A1 | 2/2007 | Amemiya et al. | |

FOREIGN PATENT DOCUMENTS

| | | |
|---|---|---|
| JP | 2002-207397 | 7/2002 |
| JP | 2004-325621 | 11/2004 |
| JP | 2005-062709 | 3/2005 |
| JP | 2006-251751 | 9/2006 |
| JP | 2007-272091 | 10/2007 |

* cited by examiner

*Primary Examiner* — Hoan Tran

(74) *Attorney, Agent, or Firm* — Dickstein Shapiro LLP

(57) ABSTRACT

A lubricant applying unit has a residual-toner collection rate X of 50% when the lubricant applying unit has not been used. The collection rate X is obtained by X=(Ta−Tb)/Ta×100, where Ta is weight per unit area of the residual toner on an area of the image carrier that has not come into contact with the lubricant applying unit, and Tb is weight per unit area of the residual toner on an area of the image carrier that has come into contact with the lubricant applying unit.

10 Claims, 5 Drawing Sheets

LUBRICANT APPLYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document 2008-080578 filed in Japan on Mar. 26, 2008 and Japanese priority document 2008-230173 filed in Japan on Sep. 8, 2008.

BACKGROUND OF THE INVENTION

1. Field of the Invention

The present invention relates to a technology for applying a lubricant to an image carrier in an image forming apparatus.

2. Description of the Related Art

Recently, a demand for forming high-quality images in an image forming apparatus, such as a copier, a facsimile, or a printer disclosed in, for example, Japanese Patent Application Laid-open No. 2007-272091, is growing. To fulfill this demand, toner that contains more fine and spherical particles is being developed. Hereinafter, such toner will be referred as fine and spherical toner. The reason behind this is that a dot-reproducibility increases as the size of the toner particles decreases, and a development performance and a transferability increase as the sphericity of the toner particles increases. However, the fine and spherical toner can hardly be produced by the conventional mixing and crushing method. Therefore, polymerized toner produced by a suspension polymerization method, an emulsion polymerization method, or a dispersion polymerization method is becoming popular as the fine and spherical toner.

However, use of the fine and spherical toner leads to the following problems when cleaning an image carrier such as a photosensitive drum after forming images.

It is difficult to scrap the fine and spherical toner with a cleaning blade that is typically employed for scrapping toner from the image carrier in the image forming apparatus. Specifically, when the cleaning blade scrapes off toner from the surface of the image carrier, the cleaning blade is sometimes deformed due to a friction between the image carrier. In case the cleaning blade is deformed, toner is caused to roll in a space between the image carrier and the cleaning blade, so that some toner remains behind on the image carrier. If the amount of toner that remains behind on the image carrier increases, a cleaning failure occurs, resulting in degradation of images such as occurrence of background fog in the images.

Furthermore, the toner that has rolled out of the cleaning blade may be remained on the surface of the image carrier leading to filming. The filming is a phenomenon that mold release agent or fluidizer contained in the toner adheres to the surface of the image carrier as a film. The filming leads to degradation of images such as occurrence of white points in one-colored area of the images.

To improve the performance of the cleaning blade, one approach is to reduce a coefficient of friction of the surface of the image carrier. Such a technique has been disclosed in, for example, Japanese Patent Application Laid-open No. 2002-207397, Japanese Patent Application Laid-open No. 2005-062709, Japanese Patent Application Laid-open No. 2004-325621, and Japanese Patent Application Laid-open No. 2006-251751. Specifically, the coefficient of friction of the surface of the image carrier is reduced by forming a thin film of a lubricant made of metallic salts of fatty acids or the like on the surface of the image carrier. When the coefficient of friction is small, adherence of the toner to the image carrier decreases. As a result, the cleaning performance of the cleaning blade can be improved and the filming can be prevented.

Japanese Patent Application Laid-open No. 2002-207397, Japanese Patent Application Laid-open No. 2005-062709, Japanese Patent Application Laid-open No. 2004-325621, and Japanese Patent Application Laid-open No. 2006-251751, teach to use a brush to apply a lubricant to the image carrier. However, if images with large image portions are formed continuously, a large amount of toner may be attached to the brush. In this situation, when the brush receives the lubricant, the lubricant may stick to the toner adhering to the brush. As a result, the performance of applying the lubricant to the surface of the image carrier drops. The above problem is more likely to occur in the configuration disclosed in Japanese Patent Application Laid-open No. 2002-207397 and Japanese Patent Application Laid-open No. 2005-062709, in which a lubricant applying device is arranged at a position upstream of a position where an image carrier is cleaned in a moving direction of the image carrier.

On the other hand, a configuration in which a lubricant applying device is arranged at a position downstream of a position where an image carrier is cleaned in a moving direction of the image carrier is disclosed in Japanese Patent Application Laid-open No. 2004-325621 and Japanese Patent Application Laid-open No. 2006-251751. With this configuration, the above problem is less likely to occur. Furthermore, because the lubricant is applied to the image carrier that has been cleaned, application of the lubricant to the image carrier does not depend on what images have been formed on the image carrier.

However, in the configuration as disclosed in Japanese Patent Application Laid-open No. 2004-325621, when a brush unit only applies the lubricant and does not flatten the applied lubricant on the image carrier, functions of the applied lubricant cannot be obtained sufficiently. On the other hand, Japanese Patent Application Laid-open No. 2006-251751 discloses a configuration in which a flattening unit that flattens the lubricant applied to the image carrier is arranged. However, arrangement of the flattening unit leads to an increase in costs and size of an apparatus.

To flatten the lubricant applied to the image carrier in a compact apparatus, it is preferable to flatten the lubricant on the image carrier while the configuration as disclosed in Japanese Patent Application Laid-open No. 2002-207397 and Japanese Patent Application Laid-open No. 2005-062709 is assured, in which the lubricant applying device is arranged at a position upstream of a position where the image carrier is cleaned in the moving direction of the image carrier and the image carrier is cleaned by the cleaning blade. However, this configuration leads to degradation of the performance of applying the lubricant to the image carrier as described above.

In the configuration disclosed in Japanese Patent Application Laid-open No. 2005-062709, a unit that removes toner from the brush unit is provided. However, because this unit removes the toner at a position between a position where the brush unit receives the lubricant and a position where the lubricant is applied to the image carrier in a rotation direction of the brush unit, the lubricant may be removed from the brush unit while the toner on the brush unit is removed. Therefore, the performance of applying the lubricant may degrade. In the configuration disclosed in Japanese Patent Application Laid-open No. 2007-272091 and Japanese Patent Application Laid-open No. 2004-325621, bias is applied to the brush unit. However, a unit for applying the bias needs to be added, which leads to increase in costs.

SUMMARY OF THE INVENTION

It is an object of the present invention to at least partially solve the problems in the conventional technology.

According to an aspect of the present invention, there is provided a lubricant applying device including a lubricant; and a lubricant applying unit that is a brush roller, the lubricant applying unit being arranged at a lubricant applying position that is opposed to an image carrier that moves in a predetermined direction and applies lubricant to the image carrier, the lubricant applying position being upstream of a cleaning position in the predetermined direction where a cleaning unit cleans residual toner from the image carrier, the lubricant applying unit having a collection rate X of 50% or less for collecting the residual toner from the image carrier in a state where the lubricant applying unit is new, wherein the collection rate X is obtained by $$X=(Ta-Tb)/Ta\times 100$$

where Ta is weight per unit area of the residual toner on an area of the image carrier that has not come into contact with the lubricant applying unit, and Tb is weight per unit area of the residual toner on an area of the image carrier that has come into contact with the lubricant applying unit.

According to another aspect of the present invention, there is provided a process cartridge including the above lubricant applying device and an image carrier. The process cartridge can be attached to and removed from an image forming apparatus that forms an image by using the image carrier, in an integrated manner.

According to still another aspect of the present invention, there is provided an image forming apparatus comprising the above process cartridge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
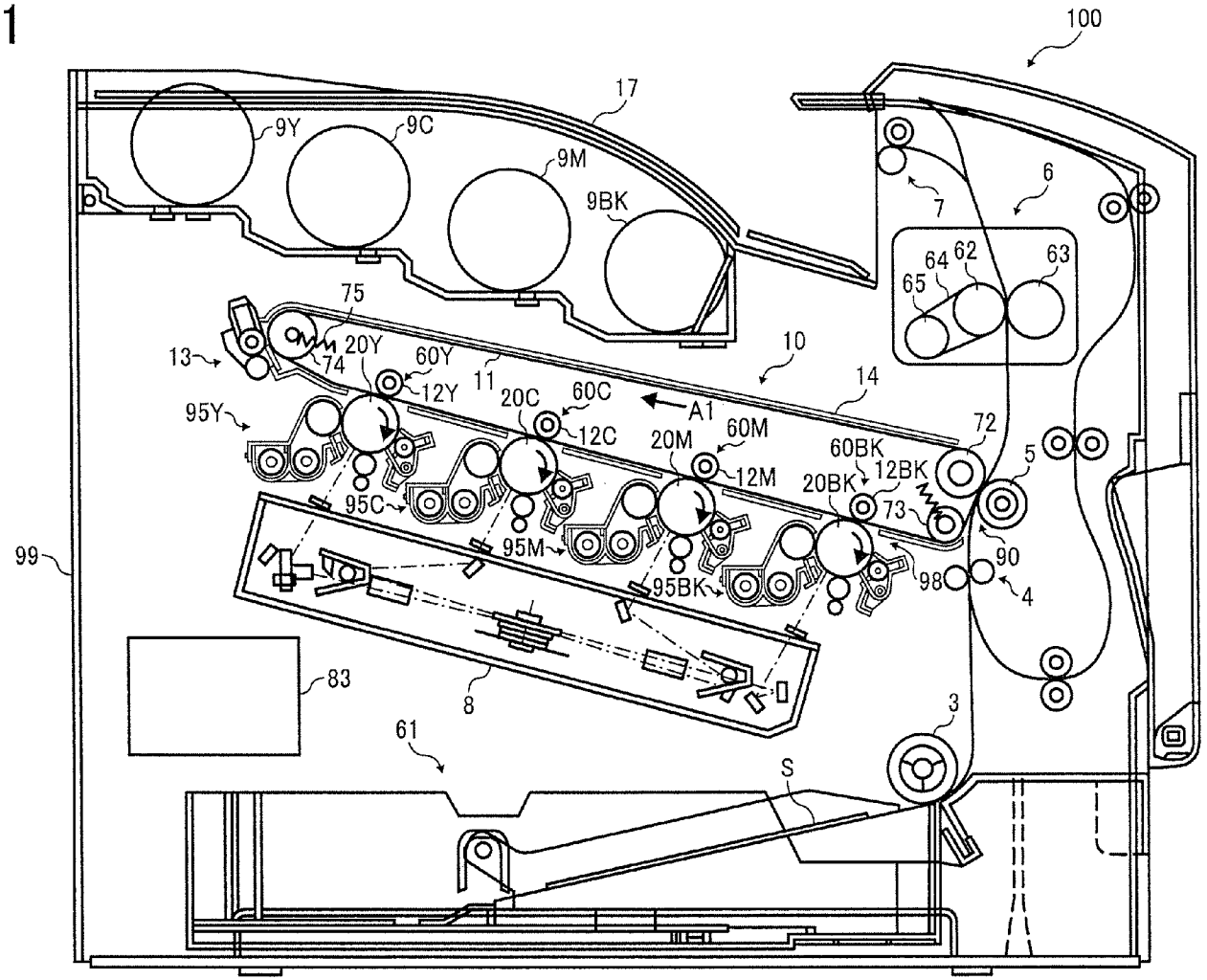
FIG. 1 is a schematic diagram of an image forming apparatus according to an embodiment of the present invention.

FIG. 1 is a schematic diagram of an image forming apparatus 100 according to an embodiment of the present invention. The image forming apparatus 100 shown in FIG. 1 is a color laser printer that enables color image formation; however, the image forming apparatus 100 is not limited to a color laser printer. In other words, the image forming apparatus 100 can be a printer, a facsimile machine, a copier, or a multifunction product.

The image forming apparatus 100 performs image forming process by using an image signal corresponding to image data received from external devices. The image forming apparatus 100 forms an image on a sheet recording medium including papers generally used in copiers, overhead projector (OHP) sheets, cardboards including cards and postcards, envelopes, and the like.

The image forming apparatus 100 is a tandem type. In other words, photosensitive drums 20Y, 20C, 20M, and 20BK that are latent image carriers are aligned in parallel to one another. The photosensitive drums 20Y, 20M, 20C, and 20BK are configured to form images for four different colors: yellow, magenta, cyan, and black (Y, M, C and BK). Each of reference codes Y, M, C, and BK means that each of members with the codes serves for forming an image in corresponding color.

The photosensitive drums 20Y, 20C, 20M, and 20BK, which serve as surface moving members, are arranged on outer circumference of a transfer belt 11, i.e., a side on which an image is to be formed. The transfer belt 11 is an intermediate transfer member as an image carrier configured as an endless belt arranged in a central part in an apparatus body 99 of the image forming apparatus 100.

The transfer belt 11 is movable in a direction represented by an arrow A1 as shown in FIG. 1, and contacts the photosensitive drums 20Y, 20M, 20C, and 20BK. Each of the photosensitive drums 20Y, 20C, 20M, and 20BK are arranged in that order in a direction represented by Al as shown in FIG. 1.

Toner images are formed on each of the photosensitive drums 20Y, 20C, 20M, and 20BK, and the toner images are sequentially superimposed one upon another onto the transfer belt 11 moving in the direction represented by the arrow A1, so that a full-color image is generated. The full-color image is then transferred onto a transfer sheet S as a recording medium. As described above, the image forming apparatus 100 is an intermediate transfer type.

The transfer belt 11 is arranged in such a manner that lower portion of the transfer belt 11 comes contact with the photosensitive drums 20Y, 20C, 20M, and 20BK, so that contact portion serves as a transfer member 98 that transfers toner images formed on the photosensitive drums 20Y, 20C, 20M, and 20BK onto the transfer belt 11.

Primary transfer rollers 12Y, 12C, 12M, 12BK are arranged adjacent to the photosensitive drums 20Y, 20C, 20M, and 20BK along inner circumference of the transfer belt 11. Toner images formed on the photosensitive drums 20Y, 20C, 20M, and 20BK are sequentially superimposed one upon another onto a same position of the transfer belt 11 by applying voltage at different timings by using the primary transfer rollers 12Y, 12C, 12M, 12BK in accordance with movement of the transfer belt 11 in the direction represented by the arrow A1.

The transfer belt 11 has multilayer structure in which a coating layer is deposited on a base layer. The base layer is made of material with less elasticity. The coating layer is made of smooth material and coats the surface of the base layer. The base layer can be made of such materials as fluorine resin, physical vapor deposition (PVD) sheet, and polyimide resin. The coating layer can be made of fluorine resin.

The transfer belt 11 includes a drift prevention guide (not shown) serving as a drift prevention member on its corner portions. The drift prevention guide is operative to prevent drifting of the transfer belt 11 in a direction orthogonal to the moving direction represented by the arrow A1 upon rotating the transfer belt 11. The drift prevention guide is made of rubber such as polyurethane rubber or silicon rubber.

The photosensitive drums 20Y, 20C, 20M, and 20BK are included in image forming units 60Y, 60C, 60M, and 60BK that are image forming units functioning as toner-image forming units for forming images of yellow, cyan, magenta, and black, respectively.

The image forming apparatus 100 includes the image forming units 60Y, 60C, 60M, and 60BK, a transfer belt unit 10, a secondary transfer roller 5, and an optical scanning device 8. The transfer belt unit 10 is opposed to the photosensitive drums 20Y, 20C, 20M, and 20BK on the upper side of the photosensitive drums 20Y, 20C, 20M, and 20BK, and includes the transfer belt 11. The secondary transfer roller 5 is opposed to the transfer belt 11, it is driven to rotate with the rotation of the transfer belt 11, and functions as a transfer unit. The optical scanning device 8 is opposed the image forming units 60Y, 60C, 60M, and 60BK on the lower side of the image forming units 60Y, 60C, 60M, and 60BK, and functions as an optical writing unit.

The image forming apparatus 100 also includes a sheet feeding unit 61, a pair of registration rollers 4, and a sensor (not shown). The sheet feeding unit 61 is a sheet feeding cassette that accommodates a stack of transfer sheets S to be conveyed towards a position between each of the photosensitive drums 20Y, 20C, 20M, and 20BK and the transfer belt 11. The registration rollers 4 send the transfer sheet S conveyed from the sheet feeding unit 61 to the transfer nip 98 between each of the photosensitive drums 20Y, 20C, 20M, and 20BK and the transfer belt 11 at a predetermined timing. The predetermined timing corresponds to a timing of forming a toner image by each of the image forming units 60Y, 60C, 60M, and 60BK. The sensor detects that a leading end of the transfer sheet S reaches the registration rollers 4.

The image forming apparatus 100 also includes a fuser 6, a pair of discharge rollers 7, toner bottles 9Y, 9C, 9M, and 9BK, a sheet-discharge tray 17, and a residual toner tank 83. The fuser 6 is a belt-type fixing unit that fixes transferred toner images on the transfer sheet S. The discharge rollers 7 discharge the transfer sheet S on which the toner image is fixed out of the apparatus body 99. The toner bottles 9Y, 9C, 9M, and 9BK are arranged above the transfer belt unit 10, filled with toner of yellow, cyan, magenta, and black, respectively, are removably mounted on the apparatus body 99, and function as toner supplying units. The sheet-discharge tray 17 is arranged on the top surface of the apparatus body 99 and on which the transfer sheet S discharged out of the apparatus body 99 by the discharge rollers 7 is stacked. The residual toner tank 83 accommodates wastes such as residual toner.

The image forming apparatus 100 also includes an operation panel (not shown) and a control unit (not shown). The operation panel functions as an input unit for inputting various settings to the image forming apparatus 100. The control unit includes a central processing unit (CPU) (not shown) and a memory (not shown), and controls the entire image forming apparatus 100.

The transfer belt unit 10 includes the primary transfer rollers 12Y, 12M, 12C, and 12BK, a drive roller 72, a transfer entrance roller 73, a cleaning counter roller 74, and a spring 75, in addition to the transfer belt 11. The drive roller 72 functions as a driving unit and around which the transfer belt 11 is extended. The spring 75 functions as a biasing unit that biases the cleaning counter roller 74 in a direction in which the tension of the transfer belt 11 is increased.

The transfer belt unit 10 also includes an intermediate-transfer-belt case 14 and a cleaning device 13. The intermediate-transfer-belt case 14 is removably mounted on the apparatus body 99, accommodates the drive roller 72, the transfer entrance roller 73, the cleaning counter roller 74, and the spring 75, and serves as a housing of the transfer belt unit 10. The cleaning device 13 is integrated with the intermediate-transfer-belt case 14, is opposed to the transfer belt 11, and functions as an intermediate-transfer-belt cleaning device that cleans the surface of the transfer belt 11.

The transfer belt unit 10 includes a driving system (not shown), a power source (not shown), and a control unit (not shown). The driving system drives the drive roller 72. The power source and the control unit serve as a primary transfer bias applying unit (not shown) that applies primary transfer bias onto the primary transfer rollers 12Y, 12M, 12C, 12BK.

The transfer entrance roller 73 and the cleaning counter roller 74 are driven rollers that are driven in accordance with the transfer belt 11 rotated by the drive roller 72. The primary transfer rollers 12Y, 12M, 12C, 12BK press the transfer belt 11 from a surface of an inner circumference of the transfer belt 11 toward the photosensitive drums 20Y, 20M, 20C, and 20BK, defining a primary transfer nips. The primary transfer nips are defined on the transfer belt 11 extended between the transfer entrance roller 73 and the cleaning counter roller 74. The transfer entrance roller 73 and the cleaning counter roller 74 have functions for stabilizing the primary transfer nip.

Primary-transfer electric field is generated due to the primary transfer bias at the primary transfer nips between the photosensitive drums 20Y, 20M, 20C, and 20BK and the primary transfer rollers 12Y, 12M, 12C, 12BK, respectively. The toner images formed on the photosensitive drums 20Y, 20M, 20C, and 20BK are primarily transferred onto the transfer belt 11 due to the primary-transfer electric field and nip pressure.

The drive roller 72 is in contact with the secondary transfer roller 5 via the transfer belt 11. The tension roller 33 is a part of the secondary transfer portion 90.

The cleaning counter roller 74 has a function of a tension roller serving as a pressurizing member that applies a predetermined tension suitable for transferring to the transfer belt 11 due to the spring 75.

The cleaning device 13 is arranged on the left side of the cleaning counter roller 74 and opposite to the transfer belt 11.

While a detailed configuration is not shown, the cleaning device 13 includes a cleaning brush (not shown) and a cleaning blade (not shown), which are brought into contact with the transfer belt 11 in an opposing manner. With the cleaning brush and the cleaning blade, the cleaning device 13 removes wastes, such as residual toner, from the surface of the transfer belt 11 to clean the transfer belt 11. The wastes, such as residual toner, collected by the cleaning are accommodated in the residual toner tank 83 via a residual toner path (not shown).

The sheet feeding unit 61 accommodates a stack of the transfer sheets S, and is arranged at a bottom portion of the apparatus body 99. The sheet feeding unit 61 includes a feed roller 3 that is brought into contact with a top surface of the transfer sheet S placed on the top of the stack. When the feed roller 3 is driven to rotate counterclockwise, the sheet feeding unit 61 feeds the transfer sheet S placed on the top of the stack towards the registration rollers 4.

The outer diameters of the registration rollers 4 are precisely set so that an imaging speed, that is, a rotation speed of the transfer belt 11 coincides with a sheet feeding speed. More particularly, manufacturing tolerance of the outer diameters is set within 0.03 millimeter.

A secondary-transfer electric field is generated at a secondary transfer portion 90 due to secondary transfer bias at a nip among the drive roller 72, the transfer belt 11, and the secondary transfer roller 5. The toner image formed on the transfer belt 11 is secondary transferred to the transfer sheet S due to the secondary-transfer electric field and a nip pressure. The drive roller 72 also functions as a secondary-transfer counter roller.

The fuser 6 includes a fixing belt 64, a fixing roller 62, a driven roller 65, and a pressurizing roller 63. The fixing belt 64 is an endless belt extended around the fixing roller 62 and the driven roller 65. The fixing roller 62 accommodates a heat source. The pressurizing roller 63 is brought into contact with the fixing roller 62 via the fixing belt 64 by pressure. When the transfer sheet S bearing the toner image passes through a fixing portion where the fixing belt 64 comes into contact with the pressurizing roller 63, the fuser 6 fixes the toner image on the transfer sheet S due to heat and pressure.

Predetermined amount of toner of yellow, cyan, magenta, and black contained in the toner bottles 9Y, 9C, 9M, and 9BK are supplied to developing devices 50Y, 50C, 50M, and 50BK included in the image forming units 60Y, 60C, 60M, and 60BK, respectively, by a toner supply mechanism (not shown). The toner bottles 9Y, 9C, 9M, and 9BK are consumable goods to be removed from the apparatus body 99 and replaced with new ones when the toners are used up.

The cleaning device 13 and the cleaning counter roller 74 are moved downward, when a black image is formed, together with the primary transfer rollers 12Y, 12M, and 12C so that the transfer belt 11 does not come into contact with each of the photosensitive drums 20Y, 20M, and 20C.

Various information input through the operation panel is recognized and identified by the control unit. Examples of the information that can be input through the operation panel include the number of sheets subjected to image formation.

The configuration of the image forming unit 60Y including the photosensitive drum 20Y is described in detail below as a representative example of the image forming units 60Y, 60C, 60M, and 60BK. Because the image forming units 60Y, 60C, 60M, and 60BK have the same configurations, reference codes corresponding to those of components in the image forming unit 60Y are assigned to components of the image forming units 60C, 60M, and 60BK in the following description, and the same explanation is not repeated.

Figure 2:
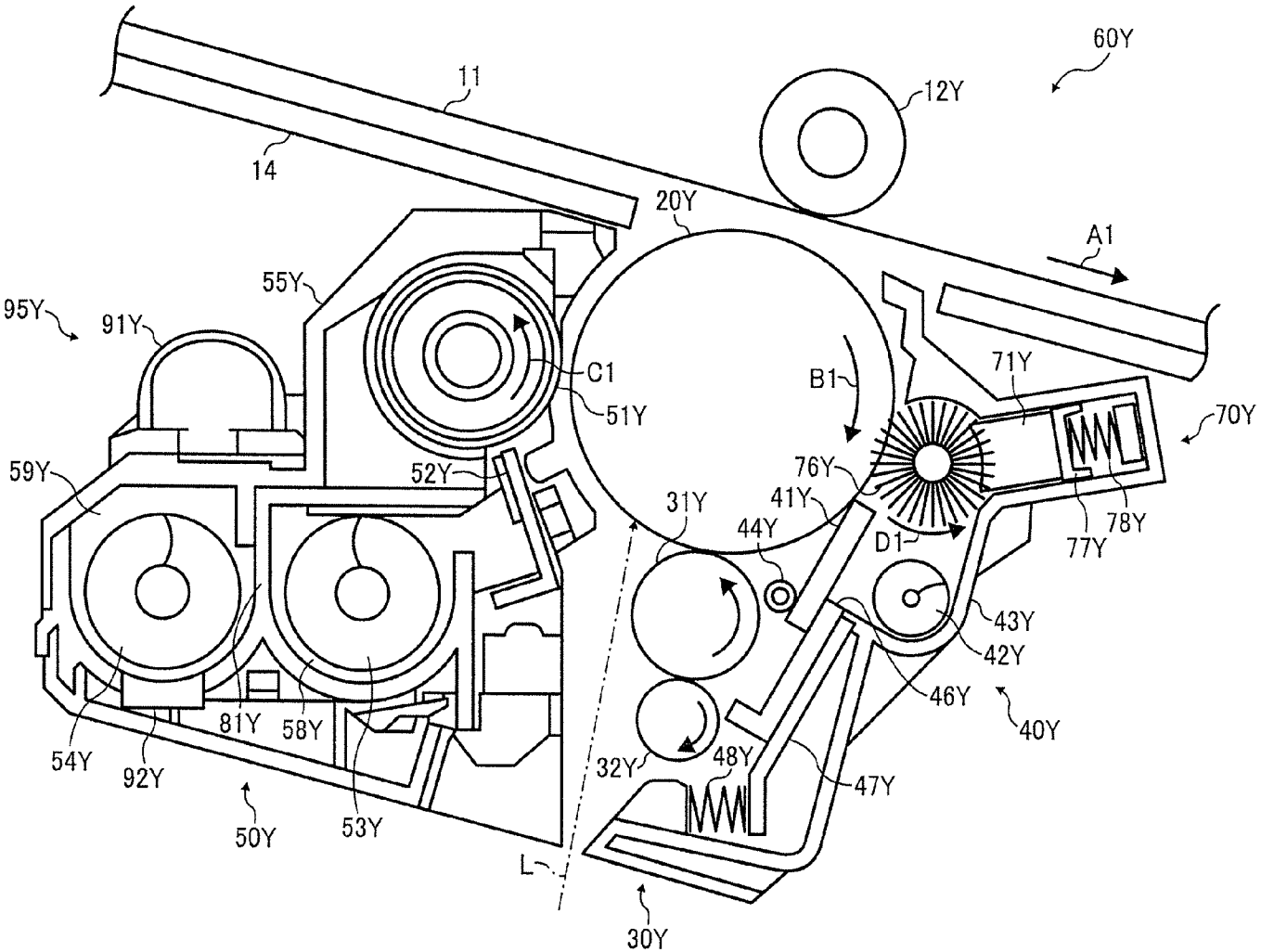
FIG. 2 is a schematic diagram of a process cartridge including a lubricant applying device in the image forming apparatus shown in FIG. 1.

As shown in FIG. 2, the image forming unit 60Y having the photosensitive drum 20Y includes the primary transfer roller 12Y, a lubricant applying device 70Y, a cleaning device 40Y, a charging device 30Y, and the developing device 50Y, all arranged around the photosensitive drum 20Y along a rotation direction of the photosensitive drum 20Y, i.e., a clockwise direction, represented by an arrow B1 in FIG. 2. The lubricant applying device 70Y applies a lubricant 71Y to the photosensitive drum 20Y where the lubricant 71Y functions as a protective agent for protecting the photosensitive drum 20Y. The cleaning device 40Y functions as a cleaning unit. The charging device 30Y functions as a charging unit. The developing device 50Y functions as a developing unit.

The charging device 30Y includes a charging roller 31Y and a cleaning roller 32Y. The charging roller 31Y is brought into contact with the surface of the photosensitive drum 20Y and driven to rotate along with the photosensitive drum 20Y. The cleaning roller 32Y is brought into contact with the charging roller 31Y, driven to rotate along with the charging roller 31Y, and functions as a charging-cleaning unit. The charging roller 31Y is connected to a voltage applying unit (not shown) that superimposes alternating-current (AC) bias on a direct-current (DC) bias, so that the surface of the photosensitive drum 20Y is neutralized, or charged to a predetermined polarity, in a charging area where the charging roller 31Y is opposed to the photosensitive drum 20Y.

The cleaning roller 32Y cleans the surface of the charging roller 31Y by being driven to rotate with the rotation of the charging roller 31Y.

While a charging system including contact rollers is used as an example in the embodiment as described above, the charging system can include an adjacent roller or a corotron.

The developing device 50Y includes a developing roller 51Y arranged closely opposing to the photosensitive drum 20Y. The developing device 50Y causes yellow toner to be electrostatically transferred to the electrostatic latent image formed on the surface of the photosensitive drum 20Y in a developing area between the developing roller 51Y and the photosensitive drum 20Y, so that the electrostatic latent image is developed into a yellow toner image.

The developing device 50Y also includes a developing case 55Y and a developing blade 52Y. The developing case 55Y is a case that accommodates developer and has an aperture at a portion opposing to the photosensitive drum 20Y. The developing blade 52Y adjusts the height of the developer on the developing roller 51Y to be a predetermined height.

The developing device 50Y also includes a first conveyor-stirring screw 53Y that functions as a first conveying unit and a second conveyor-stirring screw 54Y that functions as a second conveying unit. The first conveyor-stirring screw 53Y and the second conveyor-stirring screw 54Y are arranged opposite to each other below the developing case 55Y, and convey the developer while stirring the developer to circulate the developer.

The developing device 50Y also includes a toner-density sensor 92Y, a bias applying unit (not shown), and a driving unit (not shown). The toner-density sensor 92Y functions as a toner-density detecting unit that detects a density of toner contained in the developer accommodated in the developing case 55Y. The bias applying unit applies a DC developing bias voltage. The driving unit drives the first conveyor-stirring screw 53Y and the second conveyor-stirring screw 54Y to rotate in the same direction.

The developing device 50Y performs development by using two-component developer containing yellow toner that is nonmagnetic toner and a magnetic carrier mainly containing iron powder. The developer is accommodated in the developing case 55Y. The yellow toner has a sphericity, that is, a circularity, of 0.95 or higher, which is relatively high, and therefore, high-definition color images can be formed. The yellow toner is polymerized toner generated by a suspension polymerization method, an emulsion polymerization method, or a dispersion polymerization method to attain a relatively high circularity.

The circularity of the toner is measured as follows.

The circularity of the toner is obtained by optically detecting a particle of the toner and dividing a circumferential length of a circle having the same area as a projected area of the particle of the toner by a peripheral length of the particle of the toner. Specifically, the circularly of the toner is measured by using a flow particle image analyzer (FPIA-2000, manufactured by SYSMEX CORPORATION). More particularly, water of 100 milliliters to 150 milliliters from which impure solids are removed in advance is prepared in a predetermined container, and surfactant of 0.1 milliliter to 0.5 milliliter as dispersant and measurement sample of about 0.1 gram to 9.5 grams are added to the water. Then, an ultrasonic dispersion device is caused to perform a dispersion process for about 1 minute to 3 minutes on suspension in which the measurement sample is dispersed, so that the density of dispersion liquid is to be 3000 particles per microliter to 10000 particles per microliter. The shape and distribution of the toner are measured in this situation.

The developing roller 51Y is arranged closely opposing to the photosensitive drum 20Y such that the developing roller 51Y faces the photosensitive drum 20Y from an opening in the developing case 55Y.

The developing case 55Y includes a developing chamber 58Y that accommodates the first conveyor-stirring screw 53Y, a stirring chamber 59Y that accommodates the second conveyor-stirring screw 54Y, a separation wall 81Y that separates the developing chamber 58Y and the stirring chamber 59Y from each other, and a supply port 91Y from which the yellow toner is supplied from the toner bottle 9Y via the toner supply mechanism.

Because the first conveyor-stirring screw 53Y is opposed to the developing roller 51Y to supply the developer to the developing roller 51Y, the developing chamber 58Y is arranged closer to the developing roller 51Y than the stirring chamber 59Y.

The first conveyor-stirring screw 53Y and the second conveyor-stirring screw 54Y are driven to rotate by the driving unit such that they convey the developer in directions that are normal to the plane of FIG. 2 and opposite to each other. Therefore, the developer is circularly conveyed in one predetermined direction due to rotations of the first conveyor-stirring screw 53Y and the second conveyor-stirring screw 54Y.

The toner-density sensor 92Y detects a magnetic permeability of the developer accommodated in the developing case 55Y, and then detects the toner density of the developer through calculation using the detected magnetic permeability. While the toner-density sensor 92Y is arranged below the second conveyor-stirring screw 54Y in the example shown in FIG. 2, the toner-density sensor 92Y can be arranged below the first conveyor-stirring screw 53Y such that the toner-density sensor 92Y detects the toner density of developer that is fallen off the developing roller 51Y.

The toner supplied to the developing device 50Y via the supply port 91Y drops on the second conveyor-stirring screw 54Y in the stirring chamber 59Y. In other words, the supply port 91Y is arranged at a position where the toner can be supplied to the second conveyor-stirring screw 54Y.

The yellow toner supplied via the supply port 91Y is mixed with the developer through stirring by the second conveyor-stirring screw 54Y and the first conveyor-stirring screw 53Y, and the developer that has been mixed through the stirring is supplied to the developing roller 51Y.

The operation of mixing and stirring the newly-supplied toner with the developer is mainly performed in the stirring chamber 59Y. Therefore, the stirring chamber 59Y functions as a chamber for adjusting a toner density. The newly-supplied toner is electrically charged due to charging effect while being mixed and stirred.

The first conveyor-stirring screw 53Y and the second conveyor-stirring screw 54Y function as developer stirring units that stir the developer accommodated in the developing case 55Y. The stirring action is obtained due to movement of the developer stirred up and down when the developer moves along the first conveyor-stirring screw 53Y and the second conveyor-stirring screw 54Y.

The developing roller 51Y carries the developer accommodated in the developing chamber 58Y in a spicate manner. That is, the developing roller 51Y functions as a developer carrier that carries the developer accommodated in the developing case 55Y. The amount of the developer carried by the developing roller 51Y is controlled by the developing blade 52Y.

The developer that is adjusted to be an appropriate amount and is arranged in a layered manner on the developing roller 51Y is conveyed to the developing area between the developing roller 51Y and the photosensitive drum 20Y due to a rotation in a direction indicated by an arrow C1 in FIG. 2 and a developing bias applied by the bias applying unit.

In the developing area, the yellow toner that is electrically charged due to stirring by the first conveyor-stirring screw 53Y and the second conveyor-stirring screw 54Y and contained in the developer is electrostatically transferred to the electrostatic latent image formed on the surface of the photosensitive drum 20Y, whereby the electrostatic latent image is developed into a yellow toner image.

The developer in which the density of the yellow toner has decreased because the yellow toner has been consumed by developing the electrostatic latent image formed on the surface of the photosensitive drum 20Y is further conveyed due to the rotation of the developing roller 51Y and then falls off the developing roller 51Y. Then, the developer is mixed with other developer through stirring.

While it is explained in the embodiment that the DC developing bias voltage is applied by the bias applying unit, the developing bias can be an AC bias or a DC bias superimposed with an AC bias.

A primary-transfer bias applying unit (not shown) causes a power source (not shown) to apply a predetermined voltage of polarity opposite to the polarity of the charged toner to the primary transfer roller 12Y based on the control by a bias control unit (not shown). Accordingly, the primary transfer roller 12Y transfers the toner image carried by the photosensitive drum 20Y to the transfer belt 11. While it is preferable that the primary transfer roller 12Y transfers all toner of the toner image carried by the photosensitive drum 20Y to the transfer belt 11, some toner may remain untransformed on the photosensitive drum 20Y. Such remaining toner is called as residual toner.

As shown in FIG. 2, the optical scanning device 8 shown in FIG. 1 emits an optically-modulated laser light L towards an area between the charging area and the developing area of the photosensitive drum 20Y to expose the surface of the photosensitive drum 20Y that has been electrically charged by the charging roller 31Y. Accordingly, an electric potential of an exposed portion decreases, resulting in generating an electrostatic potential difference on the surface of the photosensitive drum 20Y. As a result, the electrostatic latent image is formed on the photosensitive drum 20Y. The developing device 50Y supplies yellow toner to the exposed portion where the electric potential has decreased, whereby a yellow toner image is formed.

The cleaning device 40Y includes a cleaning case 43Y, a cleaning blade 41Y, a shaft 44Y, a cleaning-blade supporting unit 46Y, a cleaning-blade holding unit 47Y, and a pressure spring 48Y. The cleaning case 43Y includes an aperture at a position opposing to the photosensitive drum 20Y. The cleaning blade 41Y is a blade that is brought into contact with the photosensitive drum 20Y and functions as a cleaning unit for removing wastes, such as residual toner, from the surface of the photosensitive drum 20Y. The shaft 44Y rotatably supports the cleaning blade 41Y mounted on the cleaning case 43Y so that the cleaning blade 41Y is brought into or out of contact with the photosensitive drum 20Y. The cleaning-blade supporting unit 46Y supports the cleaning blade 41Y. The cleaning-blade holding unit 47Y holds the cleaning blade 41Y via the cleaning-blade supporting unit 46Y. The pressure spring 48Y functions as a biasing unit and a pressurizing unit that biases the cleaning blade 41Y towards the photosensitive drum 20Y via the cleaning-blade supporting unit 46Y and the cleaning-blade holding unit 47Y by a predetermined pressure.

The cleaning device 40Y also includes a discharge screw 42Y. The discharge screw 42Y is rotatably mounted on the cleaning case 43Y and functions as a residual-toner conveyor screw that constitutes a residual-toner path (not shown) for conveying wastes, such as residual toner, obtained by removing toner remained on the photosensitive drum 20Y by the cleaning blade 41Y towards the residual toner tank 83.

The lubricant applying device 70Y includes the lubricant 71Y, a brush roller 76Y, a holding unit 77Y, a spring 78Y, and a motor (not shown). The lubricant 71Y is a solid compact that is shaped into a bar. The brush roller 76Y functions as a brush-roller lubricant applying unit that rotates in a direction indicated by an arrow D1 in FIG. 2, which is the forward direction of the rotation direction of the photosensitive drum 20Y indicated by an arrow B1 in FIG. 2, at a position opposing to the photosensitive drum 20Y, thereby receiving the lubricant 71Y and applying the lubricant 71Y to the photosensitive drum 20Y. The holding unit 77Y functions as a lubricant holding unit that holds the lubricant 71Y, is supported by the cleaning case 43Y, and holds the lubricant 71Y in a direction in which the lubricant 71Y comes into contact with the brush roller 76Y. The spring 78Y is a pressurizing spring that is an elastic member functioning as a pressurizing member and a biasing member that biases the lubricant 71Y towards the brush roller 76Y via the holding unit 77Y due to pressure. The motor is a driving source that drives the brush roller 76Y to rotate.

The brush roller 76Y is opposed to the photosensitive drum 20Y at a position downstream of a position where the primary transfer roller 12Y transfers the toner image on the photosensitive drum 20Y to the transfer belt 11 along the rotation direction of the photosensitive drum 20Y indicated by the arrow B1 in FIG. 2, and upstream of a position where the cleaning blade 41Y comes into contact with the photosensitive drum 20Y and removes the remained toner from the surface of the photosensitive drum 20Y. The brush roller 76Y applies the lubricant 71Y to the photosensitive drum 20Y at the above position.

The brush roller 76Y includes a shaft (not shown) made of metal and extended along a width direction of the photosensitive drum 20Y (a depth direction of FIG. 2), and a plurality of bristles arranged all over the outer surface of the shaft. More particularly, the brush roller 76Y is formed such that a base cloth (not shown) in which bristles are implanted is wound and fixed around the shaft. The length of the brush roller 76Y in the width direction is adjusted so that the entire area of the photosensitive drum 20Y in the width direction can be brought into contact with the bristles. The shaft is rotatably supported by two shaft bearings (not shown) that area arranged on side walls of the cleaning case 43Y, and driven to rotate by a motor (not shown).

The lubricant 71Y applied to the photosensitive drum 20Y by the brush roller 76Y is then uniformly spread on the surface of the photosensitive drum 20Y by the cleaning blade 41Y, whereby a protection film that is a thin-film protection layer is formed on the surface of the photosensitive drum 20Y. Thus, it is applicable to consider the cleaning blade 41Y as a constituent of the lubricant applying device 70Y.

As will be described in detail later, the brush roller 76Y is brought into contact with the photosensitive drum 20Y, so that the brush roller 76Y comes into contact with wastes, such as residual toner, carriers, or paper dust, on the photosensitive drum 20Y, and thereby the wastes are attached to the brush roller 76Y. Therefore, the brush roller 76Y functions as, although it is not a main function, a cleaning roller that removes wastes from the photosensitive drum 20Y to keep the photosensitive drum 20Y clean. Thus, the brush roller 76Y and the lubricant applying device 70Y including the brush roller 76Y can be considered as constituents of the cleaning device 40Y.

The film that is formed on the surface of the photosensitive drum 20Y by the lubricant 71Y prevents degradation, such as abrasion, caused by friction between the photosensitive drum 20Y and the cleaning blade 41Y. Therefore, the lubricant applying device 70Y functions as an abrasion-degradation preventing unit. Because low friction is maintained between the photosensitive drum 20Y and the cleaning blade 41Y, the cleaning blade 41Y has better cleaning performance. As a result, it is possible to perform cleaning with a good cleaning performance even for the above-mentioned toner having a relatively high circularity. Further, because the film is formed and the good cleaning performance is maintained, the photosensitive drum 20Y can be effectively protected. As a result filming can be prevented or suppressed.

The film also has a function for preventing degradation of the surface of the photosensitive drum 20Y caused by nearby discharge. Therefore, the lubricant applying device 70Y also functions as a discharge-degradation preventing unit. The degradation includes, for example, abrasion of the photosensitive drum 20Y due to discharge, worsening of the abrasion, and surface activation of the photosensitive drum 20Y.

As described above, the lubricant applying device 70Y applies the lubricant 71Y to the surface of the photosensitive drum 20Y, whereby the above-mentioned degradation can be suppressed.

To achieve the above effects, the lubricant 71Y is preferably made of, for example, metallic salts of fatty acids, such as lead oleate, zinc oleate, copper oleate, zinc stearate, cobalt stearate, ferric stearate, copper stearate, zinc palmitate, copper palmitate, or zinc linolenate, and fluorine resin such as polytetrafluoroethylene, polychlorotrifluoroethylene, polyvinylidene fluoride, polytrifluorochlorethylene, dichlorodifluoromethane, tetrafluoroethylene-ethylene copolymer, or tetrafluoroethylene-hexafluoropropylene copolymer. In other words, the lubricant 71Y is preferably made of material selected from metallic slats of fatty acids and fluorine resin. Furthermore, the lubricant 71Y is more preferably made of metallic stearate that can effectively reduce friction of the photosensitive drum 20Y. Moreover, the lubricant 71Y is most preferably made of zinc stearate. The lubricant 71Y can be made of two or more above-mentioned materials.

The components included in the image forming unit 60Y except for the primary transfer roller 12Y, that is, the photosensitive drum 20Y, the lubricant applying device 70Y, the cleaning device 40Y, the charging device 30Y, and the developing device 50Y, constitute a process cartridge 95Y that functions as a processing unit. The process cartridge 95Y is configured to be removed from and attached to the image forming apparatus 100 in a direction normal to the plane of FIG. 1 as one unit. By configuring a plurality of components as one process cartridge, the components can be formed as replaceable components. Therefore, maintenance capability increases, which is preferable.

When a signal indicative of formation of a color image is input to the image forming apparatus 100, the drive roller 72 is driven, so that the transfer belt 11, the transfer entrance roller 73 and the cleaning counter roller 74 are driven in accordance with the drive roller 72, and the photosensitive drums 20Y, 20M, 20C, and 20BK are rotated in the direction B1.

During rotation of the photosensitive drum 20Y in the direction B1, the surface of the photosensitive drum 20Y is uniformly charged by the charging device 31Y, and then subjected to an exposure scanning with the laser light L emitted by the optical scanning device 8, whereby an electrostatic latent image for yellow color is formed. The developing device 50Y then develops the electrostatic latent image by using yellow toner. The primary transfer roller 12Y primary transfers a toner image that is a yellow monochrome image obtained by the development to the transfer belt 11 rotating in a direction indicated by an arrow A1 in FIG. 2. Then, the lubricant applying device 70Y applies the lubricant 71Y to the photosensitive drum 20Y. Subsequently, the cleaning device 40Y removes wastes, such as residual toner, remained on the photosensitive drum 20Y after transfer of the toner image. The photosensitive drum 20Y is then to be neutralized and electrically charged by the charging roller 31Y.

At this state, the cleaning device 40Y removes, as residual wastes, the lubricant 71Y that has been degraded partially or entirely because of electric charge or the like on the photosensitive drum 20Y, together with other wastes such as residual toner. The cleaning device 40Y guides the removed wastes to be accommodated in the residual toner tank 83.

Similar to the photosensitive drum 20Y, monochrome toner images of corresponding colors are formed on the photosensitive drums 20C, 20M, and 20BK, respectively, and then the primary transfer rollers 12C, 12M, and 12Bk sequentially transfer the monochrome toner images to the same position on the transfer belt 11 rotating in the direction indicated by the arrow A1. A toner image obtained by superimposing the toner images on the transfer belt 11 is conveyed to the secondary transfer portion 90 opposing to the secondary transfer roller 5 along with rotation of the transfer belt 11 in the direction indicated by the arrow A1. Then, the toner image is secondary transferred to the transfer sheet S at the secondary transfer portion 90.

The transfer sheet S is conveyed to a portion between the transfer belt 11 and the secondary transfer roller 5 in the following manner. That is, the feed roller 3 picks up and feeds the transfer sheet S from the sheet feeding unit 61 towards the registration rollers 4, and the registration rollers 4 convey the transfer sheet S at a timing corresponding to a timing at which the leading end of the toner image on the transfer belt 11 is conveyed to a position opposite to the secondary transfer roller 5 based on a detection signal from the sensor.

After the toner image in full color is transferred to the transfer sheet S, the transfer sheet S enters the fuser 6. The transfer sheet S then passes through the fixing portion between the fixing belt 64 and the pressurizing roller 63, where the toner image that is a full color image, i.e., a composite color image, is fixed to the transfer sheet S due to heat and pressure. The transfer sheet S that has passed the fuser 6 is then discharged and stacked on the sheet-discharge tray 17 arranged on the top portion of the apparatus body 99 via the discharge rollers 7. Meanwhile, after the secondary transfer is completed, the surface of the transfer belt 11 is cleaned by the cleaning brush and the cleaning blade included in the cleaning device 13, and then subjected to a next charging process and a next developing process.

Because toners of yellow, cyan, magenta, and black are consumed in the developing devices 50Y, 50C, 50M, and 50BK, respectively during the above image formation process, the toner supply mechanism (not shown) supplies predetermined amounts of toners of yellow, cyan, magenta, black contained in the toner bottles 9Y, 9C, 9M, and 9BK to the developing devices 50Y, 50C, 50M, and 50BK, respectively.

When, similar to the configuration of the lubricant applying device 70Y as described above, a unit that applies a lubricant to an image carrier is a brush that receives a solid lubricant and applies the received lubricant to the image carrier, and if images with relatively high image area ratios are sequentially formed, a large amount of residual toner may be attached to the brush. In this situation, when the brush receives the lubricant, the lubricant is attached to the residual toner adhering to the brush. As a result, a performance of applying the lubricant to the surface of the image carrier degrades. Such degradation is likely to occur when, similar to the lubricant applying device 70Y, the lubricant is to be applied at a position upstream of a cleaning position of the image carrier in a moving direction of the image carrier.

Meanwhile, as described above, because the films made of the lubricant are formed on the surfaces of the photosensitive drums 20Y, 20C, 20M, and 20BK in the image forming apparatus 100, a cleaning performance can be improved even when toner having a relatively high circularity is used. The inventors found that a good cleaning performance can be achieved when a coefficient of friction of each of the surfaces of the photosensitive drums 20Y, 20C, 20M, and 20BK is set to 0.3 or smaller, which will be described in detail later.

Thus, a performance of applying the lubricant to the image carrier needs to be assured such that a coefficient of friction of the surface of the image carrier is maintained to be 0.3 or smaller even when images with relatively high image area ratios are sequentially formed. From this viewpoint, the inventors examined the level of attachment of residual toner to a brush roller that applies a lubricant to an image carrier, that is, a collection rate of the residual toner, and obtained the following results as described in Table 1.

TABLE 1

| | Coefficient of friction | | |
|---|---|---|---|
| Brush roller | A | B | C |
| Collection rate X when collecting residual toner from image by brush roller | 75% | 50% | 30% |
| Coefficient of friction of image after images with area ratio of 50% are printed on 100 sheets | 0.33 | 0.27 | 0.13 |
| Coefficient of friction of image after images with area ratio of 5% are printed on 100 sheets | 0.15 | 0.12 | 0.11 |

The collection rate X is obtained by the following Equation.

$$X=(Ta-Tb)/Ta\times 100$$

where Ta is weight per unit area of residual toner on an area of the surface of a photosensitive drum that has been subjected to a primary transfer and not come into contact with a brush roller, and Tb is weight per unit area of residual toner on an area of the surface of the photosensitive drum that has come into contact with the brush roller and not been cleaned by a cleaning blade.

The condition for image formation, that is, an evaluation condition, is determined as follows. Test machine: IPSiO SP C411 modified machine (a brush roller is changed, for the examination, to a brush roller A with the collection rate X of 75%, a brush roller B with the collection rate X of 50%, and a brush roller C with the collection rate of 30%).

Brush roller: brush material is conductive polyethylene terephthalate (PET) fiber, brush thickness is 5.3 deniers, and brush density is 50000 bristles/inch$^2$.

The number of sheets subjected to image formation: 100

Method of measuring a coefficient of friction: Euler-belt method (which will be explained later).

Figure 3:
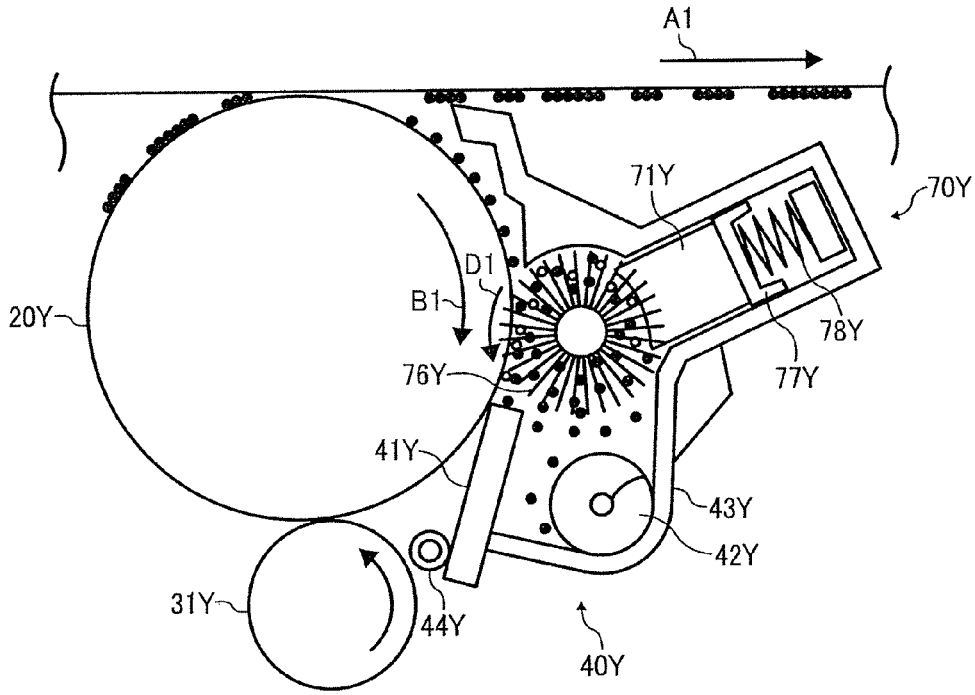
FIG. 3 is a schematic diagram for explaining how residual toner is attached to a lubricant applying unit and the lubricant applying unit applies a lubricant to an image carrier when a collection rate of the residual toner is assumed to be high in the lubricant applying device shown in FIG. 2.
Figure 4:
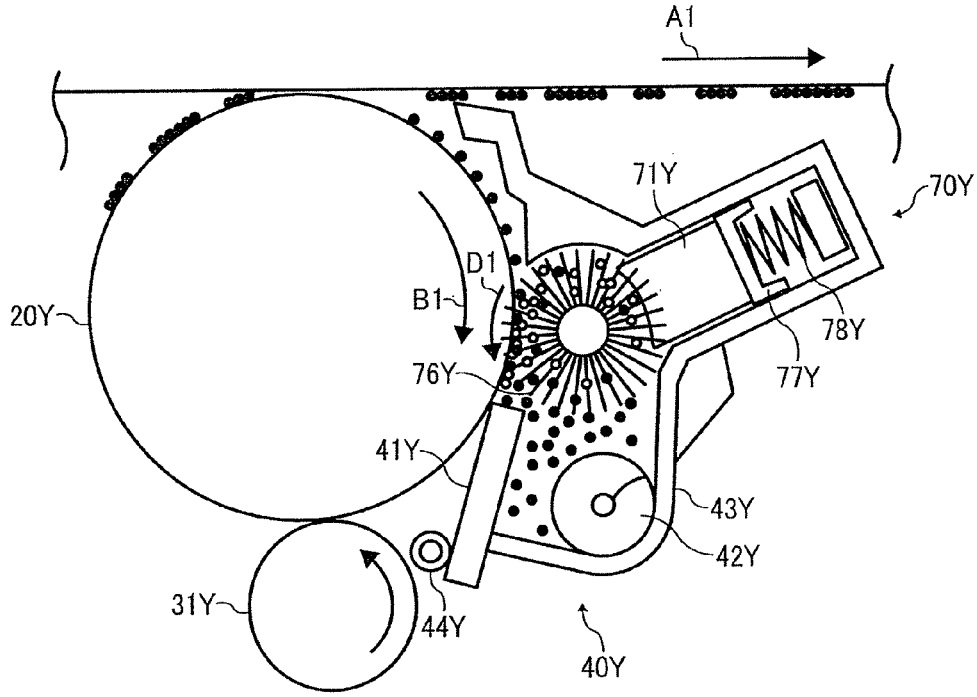
FIG. 4 is a schematic diagram for explaining how residual toner is attached to a lubricant applying unit and the lubricant applying unit applies a lubricant to an image carrier when a collection rate of the residual toner is assumed to be low in the lubricant applying device shown in FIG. 2.

It can be found from Table 1 that, as the collection rate X decreases, a coefficient of friction decreases. The reason for this can be found by comparison between FIGS. 3 and 4 as follows. In the case shown in FIG. 3 where the collection rate X is high, higher amount of residual toner is attached to the brush roller. Therefore, the brush roller cannot carry the lubricant in a desired manner, so that the lubricant cannot be applied in a desired manner. On the other hand, in the case shown in FIG. 4 where the collection rate X is low, lower amount of residual toner is attached to the brush roller. Therefore, the brush roller can carry the lubricant in a desired manner, so that the lubricant can be applied in a desired manner.

Furthermore, it can be found from Table 1 that, as the image area ratio decreases, a coefficient of friction decreases. The reason for this is as follows. When the image area ratio is low, the total amount of residual toner decreases, so that the amount of residual toner to be attached to the brush roller decreases. As a result, a situation similar to the situation shown in FIG. 4 can be obtained. When a coefficient of friction is lowered, a cleaning performance improves. Here, the image area ratio is a percentage of the number of pixels with attached toner to the total number of pixels on a transfer sheet.

The collection rate X was adjusted by adjusting a resistance of the brush roller. Detailed parameters are shown in Table 2. As can be found from Table 2, as a resistance of the brush roller decreases, the collection rate X of the residual toner decreases. This is because, when the resistance of the brush roller is low, frictional electrification of the brush roller and residual toner is less likely to occur. As a result, residual toner is less likely to be attached to the brush roller.

TABLE 2

| Resistance of brush roller [Ω] | Collection rate [%] |
|---|---|
| 1.00E+04 | 30 |
| 1.00E+05 | 50 |
| 1.00E+07 | 75 |

Figure 5:
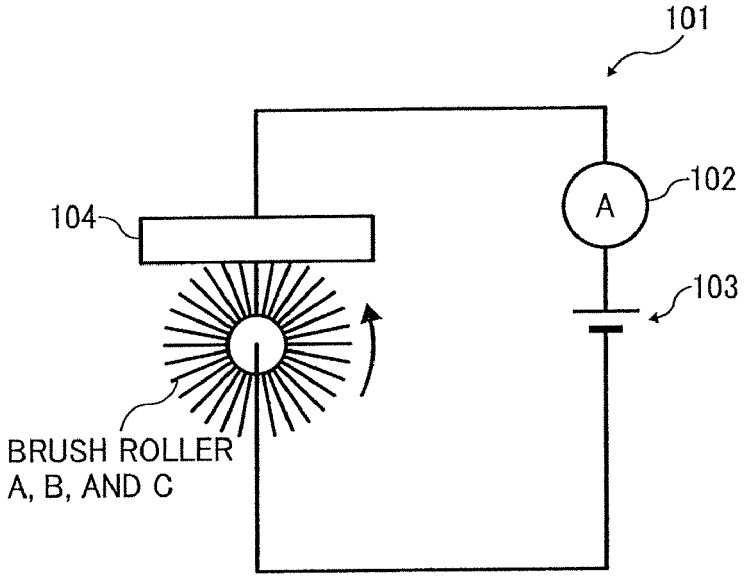
FIG. 5 is a schematic diagram of a device that measures a resistance of the lubricant applying unit.

The resistance of the brush roller was measured with a resistance measuring device 101 shown in FIG. 5. The resistance measuring device 101 includes an ammeter 102, a power source 103, and a copper plate 104. The power source has power of 500 volts, and its positive terminal is connected to one terminal of the ammeter 102. The copper plate 104 is connected to the other terminal of the ammeter 102. Each of the brush rollers A, B, and C is connected to a negative terminal of the power source 103 so that the resistance of each of the brush rollers A, B, and C is measured. The brush rollers A, B, and C have lengths of millimeters in a width direction, and the copper plate 104 also has the same length in the width direction. The brush rollers A, B, and C eat in the copper plate 104 by 0.5 millimeter along the entire length in the width direction while measurement.

Each of the brush rollers A, B, and C was prepared with no toner attached like a new brush roller. The resistance of each of the brush rollers A, B, and C was measured in a situation where each of the brush rollers A, B, and C was rotated three times and an average of currents measured by the ammeter 102 at each rotation was calculated.

Figure 6:
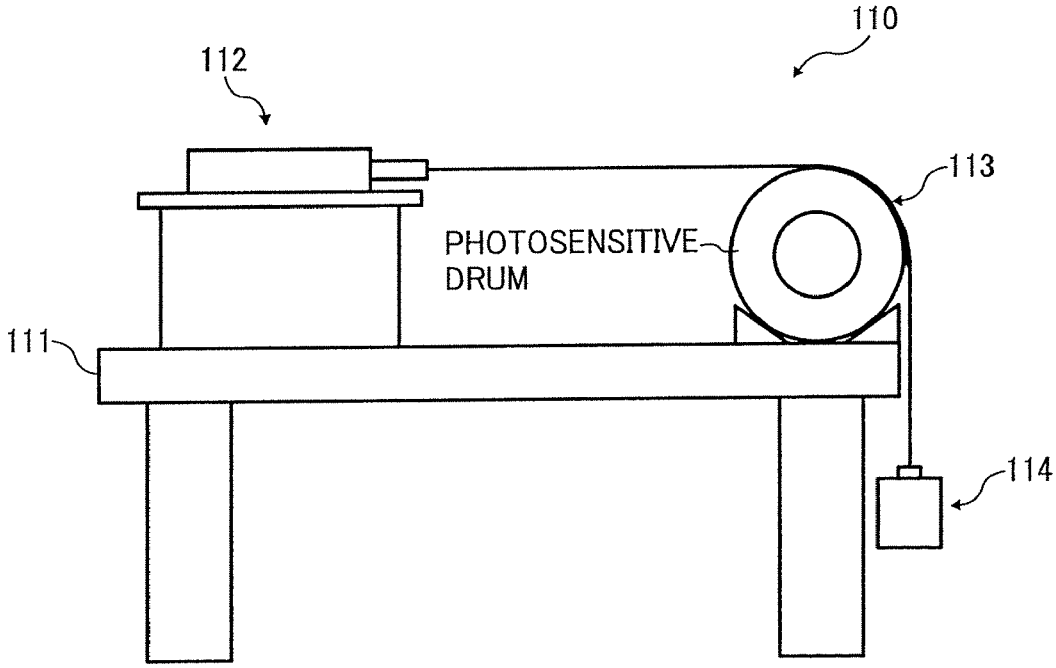
FIG. 6 is a schematic diagram of a device that measures a coefficient of friction of the image carrier.

The coefficient of friction of the photosensitive drum was measured with a friction-coefficient measuring device 110 shown in FIG. 6. The friction-coefficient measuring device 110 employs an Euler-belt method, and includes a mounting base 111, a digital push-pull gauge 112, a belt 113, and a weight 114. The mounting base 111 is a base on which the photosensitive drum is fixedly mounted. The digital push-pull gauge 112 is mounted on the mounting base 111. The belt 113 has one end connected to the digital push-pull gauge 112 and is in contact with the photosensitive drum over one-fourth of a peripheral length of the photosensitive drum. The weight 114 is connected to the other end of the belt 113 and serves as a spindle of 0.98 Newton, that is, 100 grams.

Weight F when the digital push-pull gauge 112 is pulled and the belt 113 is moved was measured, and then a coefficient of friction $\mu_s$ as a coefficient of static friction was obtained by the following Equation.

$$\mu_s = 2/\pi \times \ln(F/0.98)$$

Considering the result shown in Table 1 and the fact that the coefficient of friction of the surface of each of the photosensitive drums 20Y, 20C, 20M, and 20BK be preferably 0.3 or smaller, which will be described later, it is presumed that the collection rate X of the brush roller be preferably 50% or smaller. Accordingly, examination was performed under the following conditions. That is, the number of sheet subjected to image formation was increased to 1000, an environmental temperature was set to 10° C., which is low enough to degrade a cleaning performance, the image area ratio was set to 50%, which is high, and other factors were set to the same as the above conditions, although rotation direction of the brush roller and existence of grounding of the brush roller were changed accordingly. As a result, values shown in Table 2 were obtained. Here, the ratio of a moving speed of the surface of the image carrier to a moving speed of the surface of the brush roller was set to equal, and the brush roller was set such that the brush roller eats in the image carrier by 1.0 millimeter.

TABLE 3

| | Cleaning performance | | |
|---|---|---|---|
| Brush roller | A | B | C |
| Collection rate X when collecting residual toner from image carrier by brush roller | 75% | 50% | 30% |
| Number of times of occurrence of cleaning failure after printing 1000 sheets (Forward direction, grounded) | Large | Small | Small |
| Number of times of occurrence of cleaning failure after printing 1000 sheets (Forward direction, not grounded) | Large | Large | Large |
| Number of times of occurrence of cleaning failure after printing 1000 sheets (Backward direction, grounded) | Large | Large | Large |

TABLE 3-continued

| Brush roller | Cleaning performance A | B | C |
|---|---|---|---|
| Number of times of occurrence of cleaning failure after printing 1000 sheets (Backward direction, not grounded) | Large | Large | Large |

It can be said from Table 3 that the collection rate X needs to be set 50% or smaller. Furthermore, it can be said that the rotation direction of the brush roller needs to be set in a forward direction with respect to the rotation direction of the image carrier, and the brush roller needs to be grounded.

The reason why the rotation direction of the brush roller needs to be set in a forward direction with respect to the rotation direction of the image carrier is because a contact probability between the brush roller and residual toner on the image carrier needs to be reduced to reduce the amount of residual toner to be collected by the brush roller.

The reason why the brush roller needs to be grounded is as follows. That is, if the brush roller has low resistance as described above, frictional electrification of the brush roller and the residual toner hardly occurs, so that the residual toner is hardly attached to the brush roller electrically. Even when the frictional electrification occurs, because electrical charge is applied by the grounding, the residual toner is hardly attached to the brush roller. When the brush roller is not grounded, it seems that the state of attachment of the residual toner does not change depending on the size of the resistance of the brush roller. The brush roller is grounded via a shaft.

The fact that the coefficient of friction of the surface of each of the photosensitive drums 20Y, 20C, 20M, and 20BK needs to be 0.3 or smaller is obtained from an experimental result shown in Table 4. The experiment was performed under the conditions in which the brush roller B was used, the image area ratio was set to 50%, the number of sheets subjected to image formation was set to 1000, toner with different circularity was used, and other conditions were set to the same as the above conditions.

TABLE 4

| Circularity of toner | Evaluation of cleaning performance Coefficient of friction 0.2 | 0.3 | 0.4 |
|---|---|---|---|
| 0.94 | Assured | Assured | Assured |
| 0.95 | Assured | Assured | Not assured |
| 0.96 | Assured | Assured | Not assured |
| 0.97 | Assured | Assured | Not assured |

It can be found from Table 4 that when toner having the circularity of 0.95 or larger that enables a highly-precise color image formation and is used in the image forming apparatus 100, the coefficient of friction of the image carrier needs to be set to 0.3 or smaller to assure a preferable cleaning performance.

Detailed explanation is given below with explanation about the configuration of the image forming unit 60Y as a representative example of the image forming units 60Y, 60C, 60M, and 60BK. In the lubricant applying device 70Y, the lubricant 71Y is pressurized and pressed towards the brush roller 76Y by the spring 78Y. The amount of the lubricant 71Y to be carried by the brush roller 76Y and applied to the photosensitive drum 20Y depends on a pressurizing force, that is, a pressing force. The relation between the pressing force and the coefficient of friction of the photosensitive drum 20Y was examined and a result shown in FIG. 7 was obtained. In the examination, the brush roller C was used, the image area ratio was set to 5%, the number of sheets subjected to image formation was set to 1000, and other conditions were set to the same as the above conditions.

Figure 7:
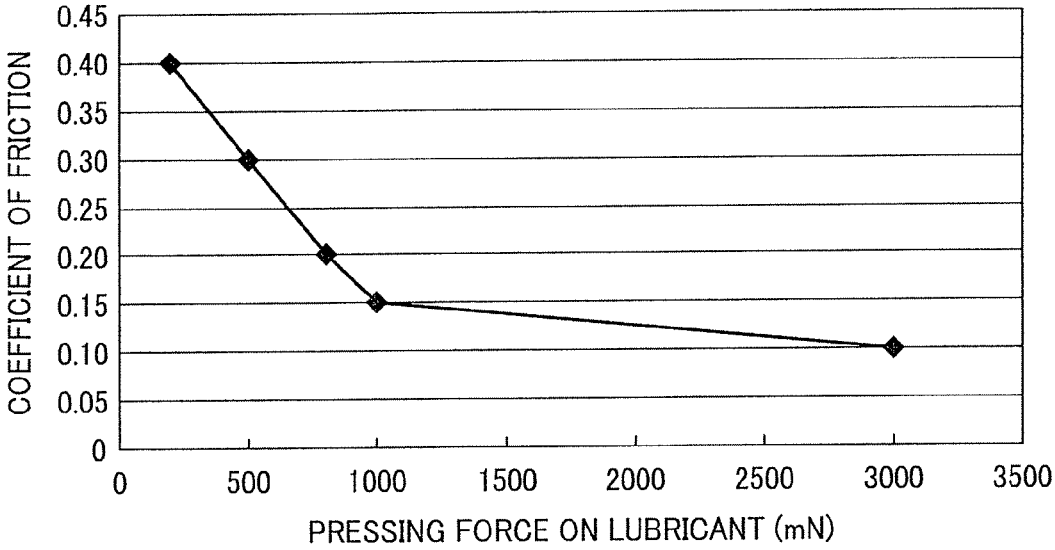
FIG. 7 is a graph of a correlation between pressure of a lubricant towards the lubricant applying unit and coefficient of friction of the image carrier.

It can be found from FIG. 7 that the lower limit of the pressing force that assures the coefficient of friction of 0.3 or smaller is 500 millinewton. If the pressing force is set to 3000 millinewton or larger, the consumption rate of the lubricant 71Y extremely increases, and thereby the lubricant 71Y is consumed in a short time. Thus, the pressing force for biasing the lubricant 71Y towards the brush roller is preferably set in a range from 500 millinewton or larger to 3000 millinewton or smaller. The pressing force can be applied by using a spring force by a spring unit, such as the spring 78Y, and the gravity of the lubricant 71Y, or the gravity of the lubricant 71Y only without the spring force. In any cases, it is preferable to apply the pressing force uniformly over the entire width of the brush roller. The lubricant applying device 70Y is configured as such.

In this manner, in the image forming apparatus 100, the image forming units 60Y, 60C, 60M, and 60BK satisfy the conditions under which a preferable cleaning performance can be obtained. Because a lubricant applying unit, such as the brush roller 76Y, is grounded via the shaft, bias is not to be applied. Therefore, it is not necessary to add components for applying bias, resulting in suppressing increase in costs for having such a configuration.

When the collection rate of the residual toner is 50%, a relatively large amount of residual toner is remained on the image carrier, such as the photosensitive drum 20Y, after the photosensitive drum 20Y passes through the area opposing to the lubricant applying unit such as the brush roller 76Y. However, the cleaning performance of the cleaning unit, such as the cleaning blade 41Y, has a sufficient capability for cleaning that amount of the residual toner.

In the image forming apparatus 100 having the above configuration, the amount of residual toner to be attached to the lubricant applying unit, such as the brush roller 76Y, is reduced to the level at which a lubricant, such as the lubricant 71Y, can be sufficiently applied to the image carrier, such as the photosensitive drum 20Y. Therefore, a desired function of the lubricant can be obtained in a preferable manner. However, it is difficult to completely prevent wastes, such as the residual toner, from being attached to the lubricant applying unit. Therefore, to reduce the amount of residual toner on the lubricant applying unit more to assure a desired function of the lubricant in a preferable manner, it is applicable to arrange a removing unit that removes the residual toner attached to the lubricant applying unit.

The above configuration is described with regard to the lubricant applying device 70Y. The same configuration can be applied to lubricant applying devices 70C, 70M, and 70BK in the image forming units 60C, 60M, and 60BK, respectively while the same explanation is not repeated.

Figure 8:
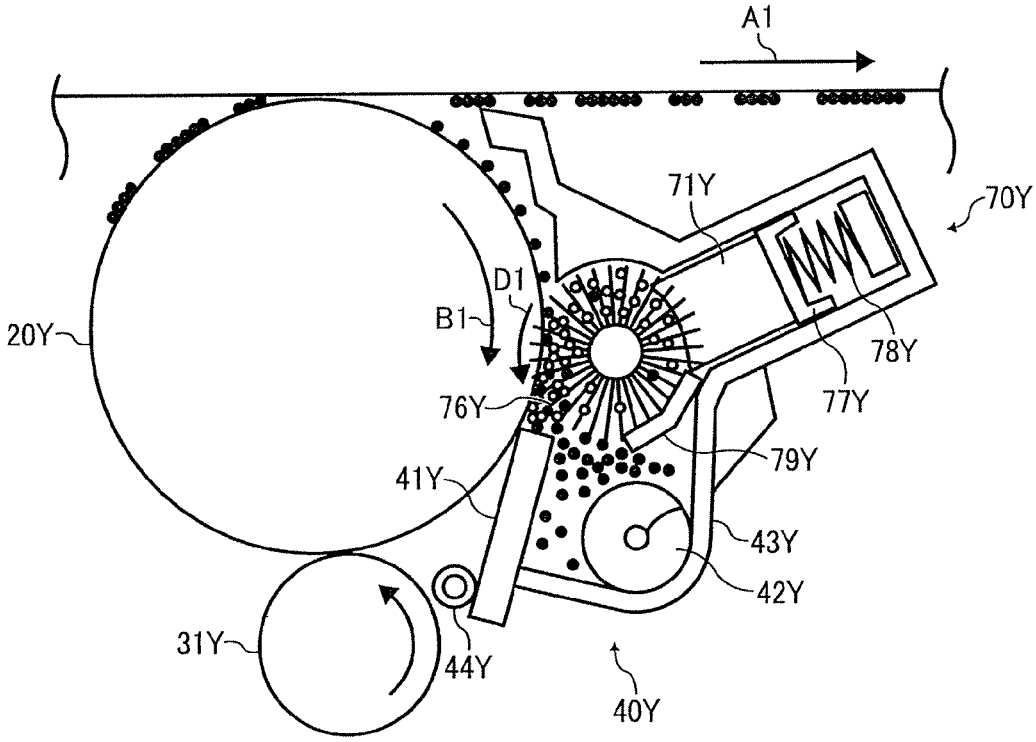
FIG. 8 is a schematic diagram for explaining how residual toner is attached to the lubricant applying unit and the lubricant applying unit applies a lubricant to the image carrier when a removing device that removes residual toner from the lubricant applying unit is arranged in the lubricant applying device.

As shown in FIG. 8, the removing unit is provided as a scraper 79Y serving as a residual-toner scraping unit that removes the residual toner from the brush roller 76Y, and is brought into contact with the brush roller 76Y at a position upstream of a position where the brush roller 76Y receives the lubricant 71Y and downstream of a position where the brush roller 76Y applies the lubricant 71Y to the photosensitive drum 20Y in the rotation direction D1 of the brush roller 76Y.

Because the scraper 79Y removes the residual toner from the brush roller 76Y and thereby the brush roller 76Y is cleaned, the brush roller 76Y can easily receive and hold the lubricant 71Y, making an application of the lubricant 71Y to the photosensitive drum 20Y easy. As a result, a performance of applying the lubricant 71Y can be improved. Because the scraper 79Y is not brought into contact with the brush roller 76Y at a position downstream of a position where the brush roller 76Y receives the lubricant 71Y and upstream of a position where the brush roller 76Y applies the lubricant 71Y to the photosensitive drum 20Y in the rotation direction D1 of the brush roller 76Y, the scraper 79Y does not remove the lubricant received by the brush roller 76Y together with residual toner. Therefore, the lubricant applying device 70Y can have an improved capability for removing residual toner and an improved performance of applying a lubricant. The removing unit can be configured to remove residual toner from the brush roller 76Y by flicking, that is, flicking the residual toner away.

While the preferable embodiments of the present invention are described above, the present invention is not limited to those embodiments. Accordingly, various modification and change can be made within the scope of the present invention as defined by the appended claims.

For example, an image carrier to which a lubricant is applied to be coated can be an intermediate transfer unit such as the transfer belt 11 instead of the photosensitive drums 20Y, 20M, 20C, and 20BK. In this case, for example, a cleaning unit, such as the cleaning device 13, can be used as a lubricant applying unit.

Although it is explained in the embodiment that binary developer is used, one-component developer can also be used. The present invention can be applied to an image forming apparatus in an one-drum type, in which a color image is generated by sequentially superimposing toner images of each color onto a single photosensitive drum, in addition to the tandem type image forming apparatus, such as the image forming apparatus 100. Furthermore, the present invention can be applied to a monochrome image forming apparatus instead of a color image forming apparatus. In each type of the image forming apparatuses, it is possible to directly transfer the toner images for each color onto a transfer paper and the like without using the intermediate transfer member.

The process cartridge is required to include at least an image carrier and a lubricant applying device in an integrated manner and to be removable to an image forming apparatus. Other components included in the process cartridge, such as a charging unit, a developing unit, or a cleaning unit, can be selectively set as appropriate depending on a life cycle of the image carrier or other component, costs, or simplicity of the configuration of the process cartridge.

According to an aspect of the present invention, use efficiency of the lubricant can be maintained, and the lubricant can be easily and stably spread with appropriate amount due to configuration in which a corner portion having curved surface comes into contact with the lubricant applying device. Therefore, it is possible to increase economic efficiency and lifetime of the lubricant. As a result, it is possible to provide a lubricant applying device that increases the lifetime of an image carrier, and forms an image in a desired quality.

According to one aspect of the present invention, in the lubricant applying device, the amount of residual toner attached to the lubricant applying device can be suppressed to the level at which the lubricant applying unit can assuredly carry the lubricant in a preferable manner and the lubricant can be assuredly applied to the image carrier in a preferable manner. Therefore, increase in costs and size of an apparatus can be prevented while the performance of applying the lubricant can be assured. Accordingly, the cleaning unit can assuredly clean the residual toner from the image carrier in an preferable manner and the image carrier can be protected, whereby an object of an application of the lubricant can be attained. As a result, images with preferable quality can be formed by using the lubricant applying device.

Furthermore, according to another aspect of the present invention, a process cartridge that is integrated with the image carrier and removably attached to the image forming apparatus is provided. Therefore, the process cartridge is easily replaceable, and images with preferable quality can be formed over a long time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant applying device comprising:

a lubricant; and a lubricant applying unit that is a brush roller, the lubricant applying unit being arranged at a lubricant applying position that is opposed to an image carrier that moves in a predetermined direction and applies lubricant to the image carrier, the lubricant applying position being upstream of a cleaning position in the predetermined direction where a cleaning unit cleans residual toner from the image carrier, the lubricant applying unit having a collection rate X of 50% or less for collecting the residual toner from the image carrier in a state where the lubricant applying unit is new, wherein the collection rate X is obtained by $$X=(Ta-Tb)/Ta\times 100$$

where Ta is weight per unit area of the residual toner on an area of the image carrier that has not come into contact with the lubricant applying unit, and Tb is weight per unit area of the residual toner on an area of the image carrier that has come into contact with the lubricant applying unit.

2. The lubricant applying device according to claim 1, wherein the lubricant applying unit has a resistance of $10^5$ ohms or smaller.

3. The lubricant applying device according to claim 1, wherein the lubricant applying unit rotates in a forward direction in the predetermined direction at the lubricant applying position.

4. The lubricant applying device according to claim 1, wherein the lubricant applying unit is grounded.

5. The lubricant applying device according to claim 1, wherein the lubricant is made of a material selected from a group of metallic salts of fatty acids and fluorine resin.

6. The lubricant applying device according to claim 1, wherein the lubricant is formed as a compact and is pressed towards the lubricant applying unit at a lubricant receiving position by a pressing force in a range between 500 millinewtons and 3000 millinewtons, and the lubricant applying unit receives a portion of the compact and applies received portion to the image carrier.

7. The lubricant applying device according to claim 1, further comprising a removing unit that is brought into contact with the lubricant applying unit at a position upstream of a position where the lubricant applying unit holds the lubricant in a rotation direction of the lubricant applying unit, and removes residual toner adhering to the lubricant applying unit.

8. A process cartridge comprising:

a lubricant applying device and an image carrier, wherein the process cartridge can be attached to and removed from an image forming apparatus that forms an image by using the image carrier, in an integrated manner, the lubricant applying device including a lubricant; and a lubricant applying unit that is a brush roller, the lubricant applying unit being arranged at a lubricant applying position that is opposed to an image carrier that moves in a predetermined direction and applies lubricant to the image carrier, the lubricant applying position being upstream of a cleaning position in the predetermined direction where a cleaning unit cleans residual toner from the image carrier, the lubricant applying unit having a collection rate X of 50% or less for collecting the residual toner from the image carrier in a state where the lubricant applying unit is new, wherein the collection rate X is obtained by $$X=(Ta-Tb)/Ta\times 100$$

where Ta is weight per unit area of the residual toner on an area of the image carrier that has not come into contact with the lubricant applying unit, and Tb is weight per unit area of the residual toner on an area of the image carrier that has come into contact with the lubricant applying unit.

9. An image forming apparatus comprising a process cartridge, the process cartridge including a lubricant applying device and an image carrier, wherein the process cartridge can be attached to and removed from an image forming apparatus that forms an image by using the image carrier, in an integrated manner, the lubricant applying device including a lubricant; and a lubricant applying unit that is a brush roller, the lubricant applying unit being arranged at a lubricant applying position that is opposed to an image carrier that moves in a predetermined direction and applies lubricant to the image carrier, the lubricant applying position being upstream of a cleaning position in the predetermined direction where a cleaning unit cleans residual toner from the image carrier, the lubricant applying unit having a collection rate X of 50% or less for collecting the residual toner from the image carrier in a state where the lubricant applying unit is new, wherein the collection rate X is obtained by $$X=(Ta-Tb)/Ta\times 100$$

where Ta is weight per unit area of the residual toner on an area of the image carrier that has not come into contact with the lubricant applying unit, and Tb is weight per unit area of the residual toner on an area of the image carrier that has come into contact with the lubricant applying unit.

10. The image forming apparatus according to claim 9, wherein toner having a circularity of 0.95 or large is used.

* * * * *